US010198998B2

(12) United States Patent
In et al.

(10) Patent No.: US 10,198,998 B2
(45) Date of Patent: Feb. 5, 2019

(54) GATE DRIVER SHIFT REGISTER AND MASK CIRCUIT AND DISPLAY DEVICE USING THE SAME

(71) Applicant: SAMSUNG DISPLAY CO., LTD., Yongin-si, Gyeonggi-do (KR)

(72) Inventors: Hai-Jung In, Seoul (KR); Bo-Yong Chung, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 219 days.

(21) Appl. No.: 15/157,067

(22) Filed: May 17, 2016

(65) Prior Publication Data

US 2016/0351160 A1 Dec. 1, 2016

(30) Foreign Application Priority Data

May 28, 2015 (KR) ..... 10-2015-0074947

(51) Int. Cl.
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 2300/0426* (2013.01);
(Continued)

(58) Field of Classification Search
CPC .. G09G 3/3677; G09G 3/3688; G09G 3/3648; G09G 3/3611; G09G 3/3674; G09G 3/3696; G09G 3/3614; G09G 3/3266; G09G 3/3685; G09G 3/2092; G09G 3/3655; G09G 3/3659; G09G 3/006; G09G 3/36; G09G 5/18; G09G 5/006; G09G 5/008; G09G 2300/0426; G09G 2300/0408; G09G 2300/08; G09G 2300/0842; G09G 2310/0286; G09G 2310/08; G09G 2310/027; G09G 2310/0267;
(Continued)

(56) References Cited

U.S. PATENT DOCUMENTS 9,479,156 B2 * 10/2016 Kwon ..... H03K 17/302
2002/0196241 A1 * 12/2002 Morita ..... G09G 3/3677 345/204
2007/0171115 A1 * 7/2007 Kim ..... G09G 3/3677 341/155
2007/0262976 A1 * 11/2007 Matsuda ..... G09G 3/3611 345/208
(Continued)

FOREIGN PATENT DOCUMENTS

KR 10-2004-0061210 A 7/2004
KR 10-2004-0092775 A 11/2004
(Continued)

*Primary Examiner* — Nalini Mummalaneni
(74) *Attorney, Agent, or Firm* — Lewis Roca Rothgerber Christie LLP

(57) ABSTRACT

There is provided a gate driver including a plurality of gate sub-drivers electrically connected to a plurality of gate lines, wherein an (n)th gate sub-driver, of the gate sub-drivers includes a shift register configured to receive an (n−1)th carry signal from an (n−1)th gate sub-driver of the gate sub-drivers adjacent to the (n)th gate sub-driver, to synchronize the (n−1)th carry signal with a first clock signal, and to output an (n)th carry signal based on the synchronized (n−1)th carry signal, and a mask configured to output a gate signal based on the synchronized (n−1)th carry signal and a mask signal, wherein n is an integer greater than or equal to 2.

19 Claims, 6 Drawing Sheets

(52) U.S. Cl.
CPC ..... *G09G 2300/0814* (2013.01); *G09G 2310/0243* (2013.01); *G09G 2310/0286* (2013.01); *G09G 2310/0289* (2013.01); *G09G 2310/08* (2013.01)

(58) Field of Classification Search
CPC ... G09G 2310/0289; G09G 2310/0248; G09G 2310/0291; G09G 2310/0297; G09G 2310/0205; G09G 2310/067; G09G 2320/0223; G09G 2320/02; G09G 2320/0233; G09G 2320/043; G09G 2320/0247; G09G 2320/0242; G09G 2320/0276; G09G 2330/021; G09G 2330/02; G09G 2330/028; G06F 9/30101; G06F 9/3885; G06F 9/30134; G06F 1/12; G06F 3/0412; G11C 19/00; G11C 19/287; G11C 27/04; G11C 7/1072; G02F 1/13454
See application file for complete search history.

(56) References Cited

U.S. PATENT DOCUMENTS

2008/0170028 A1* 7/2008 Yoshida ..... G09G 3/20 345/100
2010/0051957 A1* 3/2010 Kim ..... G02F 1/136213 257/72
2010/0109738 A1* 5/2010 Chien ..... G09G 3/3677 327/295
2012/0086694 A1* 4/2012 Tseng ..... G09G 3/3233 345/212

FOREIGN PATENT DOCUMENTS

KR 10-2008-0001856 A 1/2008
KR 10-2014-0042456 A 4/2014
KR 10-2014-0096613 A 8/2014

* cited by examiner

GATE DRIVER SHIFT REGISTER AND MASK CIRCUIT AND DISPLAY DEVICE USING THE SAME

CROSS-REFERENCE TO RELATED APPLICATION

This application claims priority to and the benefit of Korean Patent Application No. 10-2015-0074947, filed on May 28, 2015, in the Korean Intellectual Property Office (KIPO), the content of which is incorporated herein in its entirety by reference.

BACKGROUND

1. Field

Aspects of embodiments of the present inventive concept relate to a display device, and more particularly, to a gate driver and a display device including the gate driver.

2. Description of the Related Art

Generally, a display device includes a plurality of pixels to display an image. The pixels may detect electrical characteristics of their components such as a thin film transistor (TFT), an organic light emitting diode (OLED), etc. As a related art gate driver sequentially provides a gate signal to the pixels, the pixels may sequentially perform a detection function in response to the gate signal. In this case, a horizontal stripe phenomenon may occur in which horizontal stripes may be recognized by a viewer due to the sequential operation of the pixels.

Unlike a low temperature poly silicon (LTPS) TFT used in the display device, an oxide TFT used in the display device has a negative shifting characteristic or a positive shifting characteristic of a threshold voltage as the oxide TFT get stressed. Thus, the display device including the oxide TFT may operate unstably when the threshold voltage is shifted.

SUMMARY

Aspects of embodiments of the present inventive concept are directed toward a gate driver that can selectively generate a gate signal for a certain pixel row (or certain pixel rows) and can operate stably despite stressing in the oxide TFTs of the gate driver.

Aspects of embodiments of the present inventive concept are directed toward a display device including the gate driver.

According to example embodiments of the present inventive concept, there is provided a gate driver including: a plurality of gate sub-drivers electrically connected to a plurality of gate lines, wherein an (n)th gate sub-driver, of the gate sub-drivers includes: a shift register configured to receive an (n−1)th carry signal from an (n−1)th gate sub-driver of the gate sub-drivers adjacent to the (n)th gate sub-driver, to synchronize the (n−1)th carry signal with a first clock signal, and to output an (n)th carry signal based on the synchronized (n−1)th carry signal; and a mask configured to output a gate signal based on the synchronized (n−1)th carry signal and a mask signal, wherein n is an integer greater than or equal to 2.

In an embodiment, the mask includes: a pull-up block configured to transmit the synchronized (n−1)th carry signal to a first node in response to a ready signal and to output a second clock signal as the gate signal based on a voltage at the first node; and a pull-down block configured to provide a second node with a high voltage in response to the mask signal and to pull down the gate signal to have a low power voltage based on a voltage at the second node, wherein the second clock signal is an inverted signal of the first clock signal.

In an embodiment, the (n)th gate sub-driver is configured to initiate outputting the gate signal in response to the ready signal, and the (n)th gate sub-driver is further configured to stop outputting the gate signal in response to the mask signal.

In an embodiment, the mask is configured to output the second clock signal as the gate signal when the ready signal has a logic high level, and the mask is further configured to output the low power voltage as the gate signal when the mask signal has a logic high level.

In an embodiment, the pull-up block includes: a first transistor including a first electrode configured to receive the second clock signal, a second electrode electrically connected to an output terminal configured to output the gate signal, and a gate electrode electrically connected to the first node; a second transistor including a first electrode configured to receive the (n−1)th carry signal, a second electrode electrically connected to the first node, and a gate electrode configured to receive the ready signal; and a first capacitor electrically connected between the first node and the second electrode of the first transistor and configured to store a voltage at the first node.

In an embodiment, the pull-up block further includes: a third transistor including a first electrode configured to receive a low voltage, a second electrode electrically connected to the first node, and a gate electrode configured to receive the mask signal.

In an embodiment, the pull-down block includes: a fourth transistor including a first electrode electrically connected to an output terminal configured to output the gate signal, a second electrode electrically connected to the low power voltage, and a gate electrode electrically connected to the second node; a fifth transistor including a first electrode electrically connected to a high voltage source, a second electrode electrically connected to the second node, and a gate electrode configured to receive the mask signal; and a second capacitor electrically connected between the second node and the second electrode of the fourth transistor and configured to store a voltage at the second node.

In an embodiment, the pull-down block further includes: a sixth transistor and a seventh transistor, the sixth and seventh transistors electrically connected in series between a low voltage source and the second node, the sixth transistor is configured to operate in response to the (n−1)th carry signal, and the seventh transistor is configured to operate in response to the ready signal.

In an embodiment, the mask further includes: an eighth transistor configured to transfer the (n−1)th carry signal to the pull-up block in response to a third clock signal, and a logic low level of the third clock signal is lower than a logic low level of the first clock signal.

In an embodiment, the shift register includes: a second pull-up block configured to transmit the (n−1)th carry signal to a third node and to output a second clock signal as the (n)th carry signal based on a voltage at the third node; and a second pull-down block configured to transmit a high voltage to a fourth node in response to the first clock signal and to pull down the (n)th carry signal to have a low voltage based on a voltage at the fourth node, wherein the second clock signal is an inverted signal of the first clock signal.

In an embodiment, the second pull-up block includes: a ninth transistor including a first electrode configured to receive the second clock signal, a second electrode electrically connected to an output terminal configured to output the (n)th carry signal, and a gate electrode electrically connected to the third node; and a fourth capacitor electrically connected between the third node and the second electrode of the ninth transistor and configured to store a voltage at the third node.

In an embodiment, the second pull-down block includes: a tenth transistor including a first electrode electrically connected to an output terminal configured to output the (n)th carry signal, a second electrode electrically connected to a low voltage source supplying the low voltage, and a gate electrode electrically connected to the fourth node; an eleventh transistor including a first electrode configured to receive the high voltage, a second electrode electrically connected to the fourth node, and a gate electrode configured to receive a third clock signal; and a fifth capacitor electrically connected between the fourth node and the low voltage source and configured to store a voltage at the fourth node.

In an embodiment, the second pull-down block further includes: a six capacitor electrically connected between the fourth node and the gate electrode of the tenth transistor.

In an embodiment, the second pull-down block further includes: a twelfth transistor including a first electrode configured to receive the first clock signal, a second electrode electrically connected to the fourth node, and a gate electrode configured to receive the (n−1)th carry signal.

In an embodiment, the shift register further includes: an eighth transistor including a first electrode configured to receive the (n−1)th carry signal, a second electrode electrically connected to the third node, and a gate electrode configured to receive the third clock signal; and a third capacitor electrically connected between the third node and the gate electrode of the twelfth transistor.

In an embodiment, the shift register further includes: a reset block configured to initialize a voltage at the third node, a voltage at a forth node, and a voltage at an output terminal from which the (n)th carry signal is output to have the low voltage based on a reset signal.

In an embodiment, the reset block includes a plurality of transistors configured to electrically connect the third node, the fourth node, and the output terminal to the low voltage in response to the reset signal.

According to example embodiments of the present inventive concept, there is provided a display device including: a display panel including a plurality of gate lines, a plurality of data lines, and a plurality of pixels at crossing regions of the gate lines and the data lines; a data driver configured to provide data signals to the pixels through the data lines; a timing controller configured to generate a first clock signal and a second clock signal that is an inverted signal of the first clock signal, the timing controller being configured to control the data driver and a gate driver; and the gate driver including a plurality of gate sub-drivers electrically connected to the gate lines, the gate sub-drivers being configured to supply a gate signal to the pixels through the gate lines, wherein an (n)th gate sub-drivers of the gate sub-drivers includes: a shift register configured to receive an (n−1)th carry signal from an (n−1)th gate sub-driver located adjacent to the (n)th gate sub-driver, to synchronize the (n−1)th carry signal with the first clock signal, and to output an (n)th carry signal based on synchronized (n−1)th carry signal; and a mask configured to output the second clock signal as the gate signal based on the synchronized (n−1)th carry signal and a mask signal, wherein n is an integer greater than or equal to 2.

In an embodiment, the display panel is configured to receive a sensing voltage from an external component based on the gate signal and to measure a pixel driving current generated based on the sensing voltage.

In an embodiment, the timing controller is configured to generate a start pulse signal and a ready signal, and the gate driver is configured to selectively drive at least one pixel among the pixels based on the start pulse signal, the ready signal, and the mask signal.

Therefore, a gate driver according to some example embodiments of the present inventive concept may selectively generate a gate signal for only a certain pixel row by including a gate driving unit (e.g., a gate sub-driver) that generates the gate signal based on an (n−1)th carry signal and a mask signal. In addition, because the gate driver uses a capacitor coupling, the gate driver may operate stably although oxide TFTs of the gate driver get stressed.

A display device according to some example embodiments of the present inventive concept may reduce or eliminate a horizontal stripe phenomenon (i.e., may reduce or prevent horizontal stripes from being recognized by a viewer) by randomly selecting a certain pixel row and by detecting and compensating pixel characteristics of the certain pixel row.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Hereinafter, the present inventive concept will be explained in more detail with reference to the accompanying drawings.

Figure 1:
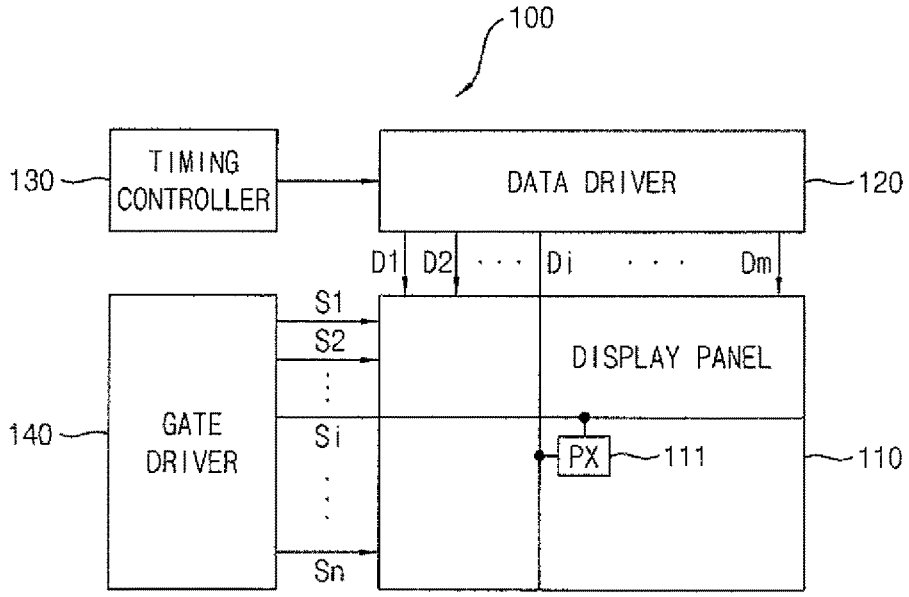
FIG. 1 is a block diagram illustrating a display device according to some example embodiments of the present inventive concept.

FIG. 1 is a block diagram illustrating a display device according to some example embodiments of the present inventive concept.

Referring to FIG. 1, the display device 100 may include a display panel 110, a data driver 120, a timing controller 130, and a gate driver 140.

The display device 100 may display an image based on image data provided from an external circuit. For example, the display device 100 may be an organic light emitting display device.

The display panel 110 may include a plurality of gate lines S1 through Sn, a plurality of data lines D1 through Dm, and a plurality of pixels 111 disposed at crossing regions of gate lines S1 through Sn and data lines D1 through Dm, where m and n are integers greater than or equal to 2. Each of the pixels 111 may emit light based on a gate signal provided through the gate lines S1 through Sn and a data signal provided through the data lines D1 through Dm. Each of the pixels 111 may sense (e.g., detect or measure) characteristics of internal elements. A configuration of the pixels 111 to sense the characteristics of the internal elements will be described in further detail with reference to FIG. 2A.

The data driver 120 may provide the data signal to the display panel 110. The data driver 120 may generate the data signal based on an image data provided from the timing controller 130 and may provide the data signal to the display panel 110 (e.g., the pixels 111) through the data lines D1 through Dm in response to a data driving control signal.

The timing controller 130 may control the data driver 120 and the gate driver 140. The timing controller 130 may generate the data driving control signal and may provide the data driving control signal to the data driver 120. The timing controller 130 may generate a clock signal and a gate driving control signal, and may provide the gate driver 140 with the clock signal and the gate driving control signal.

The gate driver 140 may generate a gate signal based on the gate driving control signal provided from the timing controller 130 and may provide the gate signal to the display panel 110.

The gate driver 140 may sequentially generate the gate signal for the gate lines S1 through Sn, may concurrently (e.g., simultaneously) generate the gate signal for the gate lines S1 through Sn, or may generate the gate signal for only a certain gate line (i.e., a certain pixel row), for example, the gate driver 140 may generate the gate signal for a few pixels selected among the pixels 111. In some examples, the gate driver 140 may generate the gate signal sequentially using a shift register operation of a plurality of gate driving units (e.g., a plurality of gate sub-drivers) that are electrically connected in series. For example, the gate driver 140 may generate the gate signal of the certain pixel row based on a mask signal. Here, the mask signal may be provided from the timing controller 130. A configuration of the gate driver 140 will be described in further detail with reference to FIGS. 3 through 5.

As described above, the gate driver 140 may generate the gate signal to select the certain pixel row based on the mask signal. Therefore, only a few pixels included in the selected pixel row may perform an operation to sense characteristics of internal elements.

Figure 2A:
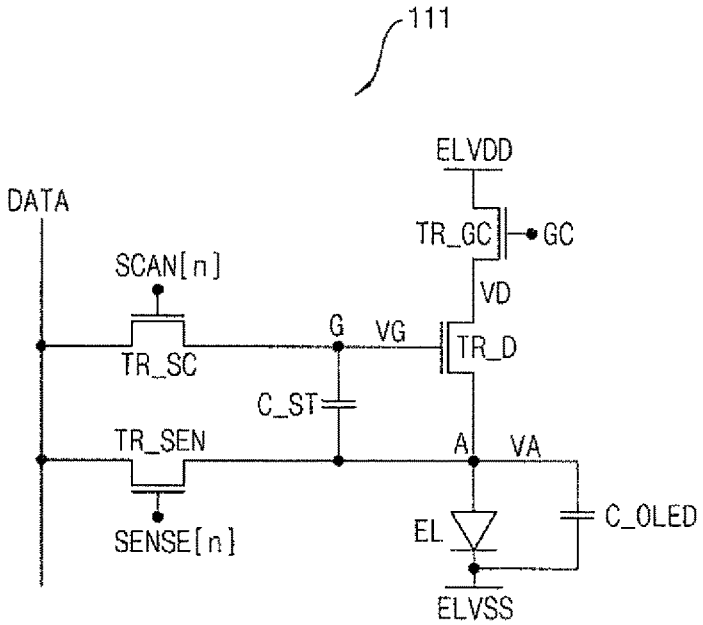
FIG. 2A is a circuit diagram illustrating an example of a pixel included in the display device of FIG. 1.

FIG. 2A is a circuit diagram illustrating an example of a pixel included in the display device of FIG. 1.

Referring to FIG. 2A, the pixel 111 may store a data signal DATA in response to a scan signal (e.g., a first gate signal SCAN[n]) and may emit light corresponding to the data signal DATA in response to a light emission control signal GC. The pixel 111 may receive a sensing voltage in response to the first gate signal SCAN[n] and may sense (e.g., measure or detect) a driving current of the pixel 111 (i.e., a driving current that flows through an organic light emitting diode EL based on the sensing voltage) in response to a sensing signal (e.g., a second gate signal SENSE[n]).

The pixel 111 may include a driving transistor TR_D, a switching transistor TD_SC, a sensing transistor TR_SEN, a light emission control transistor TR_GC, a storage capacitor C_ST, and an organic light emitting diode EL.

The driving transistor TR_D may include a first electrode for receiving a high power voltage ELVDD, a second electrode that is electrically connected to an anode of the organic light emitting diode EL, and a gate electrode for receiving the data signal DATA. The driving transistor TR_D may transmit the driving current to the organic light emitting diode EL in response to the data signal DATA.

The switching transistor TD_SC may include a first electrode that is electrically connected to a data line, a second electrode that is electrically connected to a gate electrode of the driving transistor TR_D, and a gate electrode receiving the scan signal (e.g., the first gate signal SCAN[n]). The switching transistor TD_SC may transfer the data signal to the driving transistor TR_D in response to the scan signal (e.g., the first gate signal SCAN[n]).

The storage capacitor C_ST may be electrically connected between a gate electrode of the driving transistor TR_D and a second electrode of the driving transistor TR_D. The storage capacitor C_ST may store the data signal DATA.

The light emission control transistor TR_GC may include a first electrode for receiving the high power voltage ELVDD, a second electrode that is electrically connected to a first electrode of the driving transistor TR_D, and a gate electrode for receiving the light emission control signal GC. The light emission control transistor TR_GC may diode-couple the high power voltage ELVDD and the driving transistor TR_D in response to the light emission control signal GC.

The organic light emitting diode EL may be electrically connected between a second electrode of the driving transistor TR_D and a low power voltage ELVSS. The organic light emitting diode EL may emit light based on the driving current supplied through the driving transistor TR_D.

The sensing transistor TR_SEN may include a first electrode that is electrically connected to the anode of the organic light emitting diode EL, a second electrode that is electrically connected to the data line, and a gate electrode for receiving the sensing signal (e.g., the second gate signal SENSE[n]). The sensing transistor TR_SEN may measure a voltage across the organic light emitting diode EL based on the second gate signal SENSE[n].

The pixel 111 of FIG. 2A is exemplarily illustrated to describe a function of detecting an electrical properties. However, the pixel 111 is not limited thereto. For example, the pixel 111 may have a 6T1C or 7T1C structure.

Figure 2B:
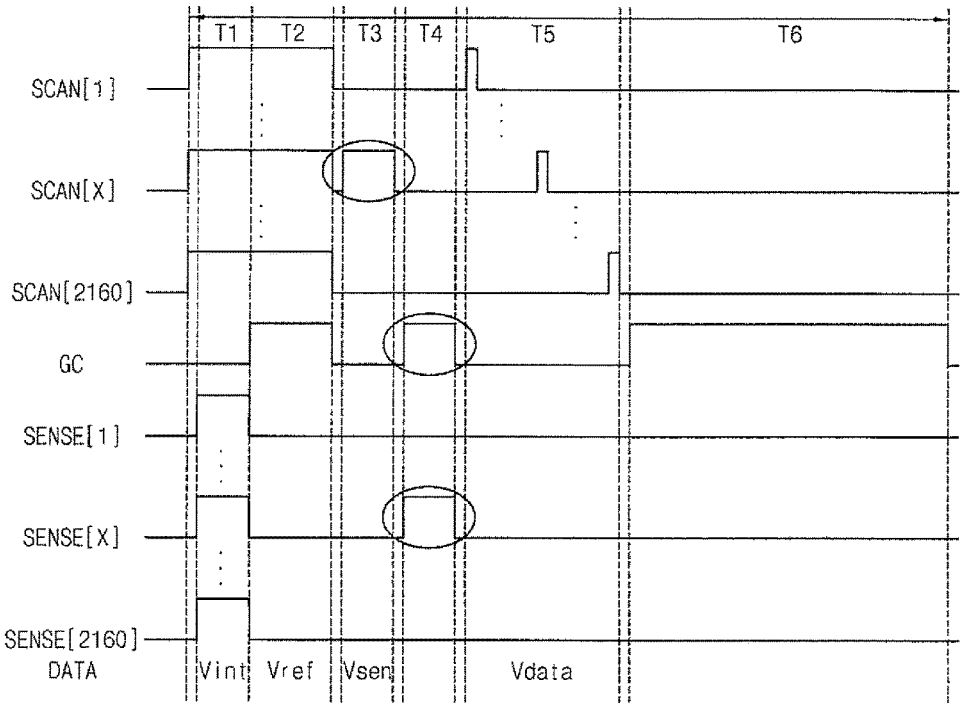
FIG. 2B is a waveform diagram illustrating a gate signal generated by a gate driver included in the display device of FIG. 1.

FIG. 2B is a waveform diagram illustrating a gate signal generated by a gate driver included in the display device of FIG. 1. One frame may include an initial period T1, a threshold voltage compensating period T2, a sensing voltage supplying period T3, a sensing period T4, a data writing period T5, and an emission period T6.

Referring to FIGS. 2A and 2B, in the initial period T1, scan signals SCAN[1] through SCAN[2160] having a logic high level (e.g., a high voltage level) and sensing signals SENSE[1] through SENSE[2160] having a logic low level (e.g., a low voltage level) may be supplied to pixel rows (e.g., pixels 111 included in the pixel rows). Here, an initialization voltage Vint may be supplied to the data line. Therefore, a node A (i.e., a node in which a second electrode of the driving transistor TR_D is electrically connected to an anode of the organic light emitting diode EL) may be initialized to the Vint in all of the pixels 111.

In the threshold voltage compensating period T2, the scan signals SCAN[1] through SCAN[2160] having a logic high level, the sensing signals SENSE[1] through SENSE[2160] having a logic low level, and a light emission control signal GC having a logic high level may be supplied to the pixel rows. Here, a reference voltage Vref may be supplied to the data line. Therefore, a voltage at the node A may be represented as the reference voltage Vref minus a threshold voltage Vth, where the threshold voltage Vth may be a threshold voltage of the driving transistor TR_D.

In the sensing voltage supplying period T3, the scan signal SCAN[x] having a logic high level may be supplied to a certain pixel row (e.g., an (x)th pixel row), and other scan signals SCAN[1] and SCAN[2160] having a logic low level may be supplied to other pixel rows. Here, a sensing voltage Vsen may be supplied to the data line. The certain pixel row may be a pixel row for detecting a threshold voltage and may be selected by the scan signal SCAN[x]. Therefore, the sensing voltage Vsen may be supplied to the node G (i.e., a node in which a gate electrode of the driving transistor TR_D is electrically connected to a second electrode of the light emission control transistor TR_GC) of only the certain pixel.

In the sensing period T4, the sensing signal SENSE[x] having a logic high level may be supplied to the certain pixel row (e.g., the (x)th pixel row), and other sensing signals SENSE[1] and SENSE[2160] having a logic low level may be supplied to other pixel rows. Here, a light emission control signal GC having a logic high level may be supplied to the certain pixel row. Therefore, a driving current flowing through the driving transistor TR_D of a certain pixel (e.g., a pixel included in the (x)th pixel row) may flow to an external circuit through the sensing transistor TR_SEN and the data line. The driving current may be sensed by an external read-out integrated circuit (IC). A sensed driving current may be used to compensate a data signal supplied to the certain pixel.

In the data writing period T5, the sensing signals SENSE [1] through SENSE[2160] having a logic low level may be supplied to all of the pixel rows, and the scan signals SCAN[1] through SCAN[2160] having a logic high level may be supplied to all of the pixel rows sequentially. The pixels 111 may write a data signal Vdata to the node G sequentially according to the scan signals SCAN[1] through SCAN[2160]. The data signal Vdata may be a data signal compensated based on a driving current that is sensed in the sensing period T4.

In the emission period T6, the scan signals SCAN[1] through SCAN[2160] having a logic low level, the sensing signals SENSE[1] through SENSE[2160] having a logic low level, and the light emission control signal GC having a logic high level may be supplied to all of the pixel rows. The pixels 111 (e.g., the organic light emitting diode EL) may emit light based on the data signal Vdata.

As described above, the gate signal may be supplied to all of the pixel rows in the initial period T1, the threshold voltage compensating period T2, and the emission period T6, and the gate signal may be selectively supplied to the certain pixel row in the sensing voltage supplying period T3 and the data writing period T5. In addition, the gate signal may be sequentially supplied to the pixel rows in the data writing period T5.

That is, the gate driver 140 according to example embodiments may perform concurrent driving (e.g., a simultaneous driving) to concurrently (e.g., simultaneously) supply the gate signal to all of the pixel rows, may perform selective driving to supply the gate signal to only a certain pixel row, and may perform sequential driving to sequentially supply the gate signal to the pixel rows.

Figure 3:
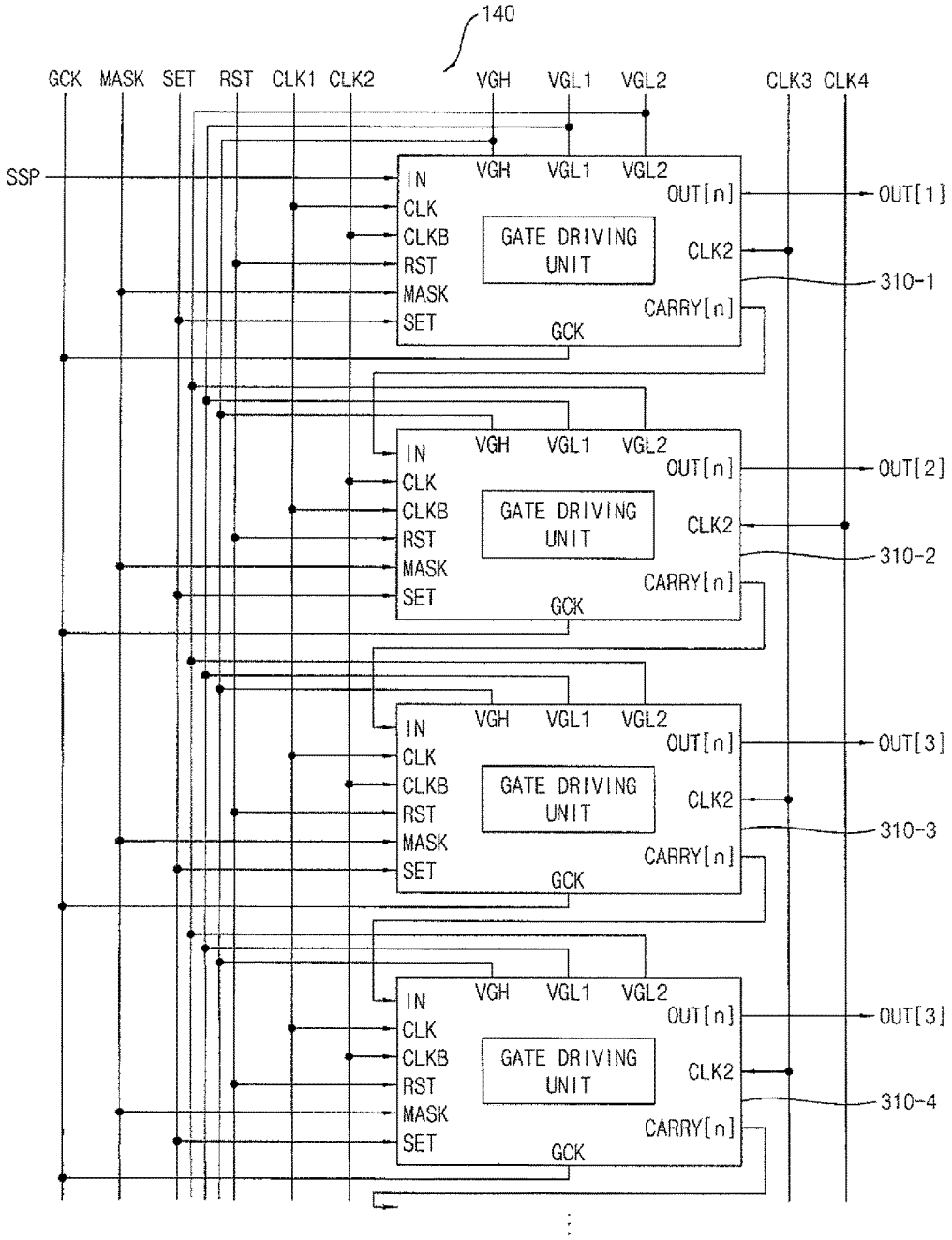
FIG. 3 is a block diagram illustrating an example of a gate driver included in the display device of FIG. 1.

FIG. 3 is a block diagram illustrating an example of a gate driver included in the display device of FIG. 1.

Referring to FIGS. 1 and 3, the gate driver 140 may include a plurality of gate driving units (e.g., a plurality of gate sub-drivers) 310-1 through 310-4 that are electrically connected to respective ones of a plurality of gate lines S1 through Sn. The gate driving units 310-1 through 310-4 may sequentially output gate signals OUT[1] through OUT[4] based on the start signal SSP provided from the timing controller 130.

A first gate driving unit 310-1 may receive the start signal SSP and may generate a first carry signal Carry[1] and a first gate signal OUT[1]. A second driving unit 310-2 may generate a second carry signal Carry[2] and a second gate signal OUT[2] based on the first carry signal Carry[2]. For example, an (n)th gate driving unit 310-n may generate an (n)th carry signal Carry[n] and an (n)th gate signal OUT[n] based on an (n−1)th carry signal Carry[n−1], where n is a positive integer.

The (n)th gate driving unit may output a gate signal OUT[n] having a logic high level or a logic low level based on a ready signal SET, a mask signal MASK, and the (n−1)th carry signal Carry[n−1]. Here, the ready signal SET may be a control signal for the (n)th gate driving unit 310-n to initiate (e.g., prepare) outputting the gate signal OUT[n], and the mask signal MASK may be a control signal to prevent the (n)th gate driving unit 310-n from outputting the gate signal OUT[n].

For example, if a level of the ready signal SET is changed from a logic high level to a logic low level and a level of the mask signal MASK is the logic low level in the sensing voltage supplying period T3 described with reference to FIG. 2B, the gate driving units 310-1 through 310-4 may sequentially generate and output the gate signals OUT[1] through OUT[4] having a logic high level. For example, if a level of the mask signal MASK is the logic low level in a certain period, only an (n)th gate driving unit 310-n that receives an (n−1)th carry signal Carry[n−1] having a logic high level in the certain period may output the gate signal OUT[n] having a logic high level.

When a power signal GCK supplied as a low power voltage of an output terminal (or an output stage) of the gate driving units 310-1 through 310-4 is a high voltage VGH instead of a low voltage VGL, the gate driving units 310-1 through 310-4 may concurrently (e.g., simultaneously) output the gate signals OUT[1] through OUT[4] having a logic high level.

The gate driver 140 may use a first low voltage VGL1, a second low voltage VGL2, a third low voltage VGL3, and a fourth low voltage VGL4. The first low voltage VGL1 may be a low voltage supplied to the display panel 110, and the second low voltage VGL2 may have a level lower than that of the first low voltage VGL1. For example, when the first low voltage VGL1 is 0 volt (V), the second low voltage VGL2 may be −ΔV volt (V) that is lower than the first low voltage VGL1 by ΔV volt (V). Similarly, the third low voltage VGL3 and the fourth low voltage VGL4 may have a level lower than the second low voltage VGL2 and the third low voltage VGL3, respectively. For example, the third low voltage VGL3 and the fourth low voltage VGL4 may be −2*ΔV volt (V) and −3*ΔV volt (V), respectively.

The first low voltage VGL1, the second low voltage VGL2, the third low voltage VGL3, and the fourth low voltage VGL4 may ensure that the gate driver 140 operates stably when a transistor included in the gate driver 140 is an oxide thin film transistor (TFT).

Similarly, the gate driver 140 may use a third clock signal CLK3 and a fourth clock signal CLK4 as well as a first clock signal CLK1 and a second clock signal CLK2. The first clock signal CLK1 and the second clock signal CLK2 may synchronize carry signals (e.g., an (n−1)th carry signal Carry[n−1]) that is supplied to the gate driving units and may be used to generate carry signals (e.g., an (n)th carry signal Carry[n]). The second clock signal CLK2 may be an inversed signal of the first clock signal CLK1. That is, the second clock signal CLK2 has a logic low level when the first clock signal CLK1 has a logic high level, and the second clock signal CLK2 has a logic high level when the first clock signal CLK1 has a logic low level. The third clock signal CLK3 and the fourth clock signal CLK4 may have a logic low level lower than that of the first clock signal CLK1 and the second clock signal CLK2, respectively. For example, when a logic low level of each of the first clock signal CLK1 and the second clock signal CLK2 is the first low voltage VGL1, a logic low level of each of the third clock signal CLK3 and the fourth clock signal CLK4 may be the third low voltage VGL3.

In example embodiments, the gate driver 140 may include a plurality of gate driving units 310-1 through 310-4 that are electrically connected to respective ones of a plurality of gate lines S1 through Sn, and the (n)th gate driving unit 310-n among the plurality of gate driving units 310-1 through 310-4 may include a shift register to receive the (n−1)th carry signal Carry[n−1] from an (n−1)th gate driving unit 310-n−1 located adjacent to the (n)th gate driving unit 310-n, to synchronize the (n−1)th carry signal Carry[n−1] with clock signals CLK1 through CLK4, and to output the (n)th carry signal Carry[n] based on the synchronized (n−1)th carry signal Carry[n−1], and a mask to output a gate signal OUT[n] based on the synchronized (n−1)th carry signal Carry[n−1] and the mask signal MASK.

Figure 4:
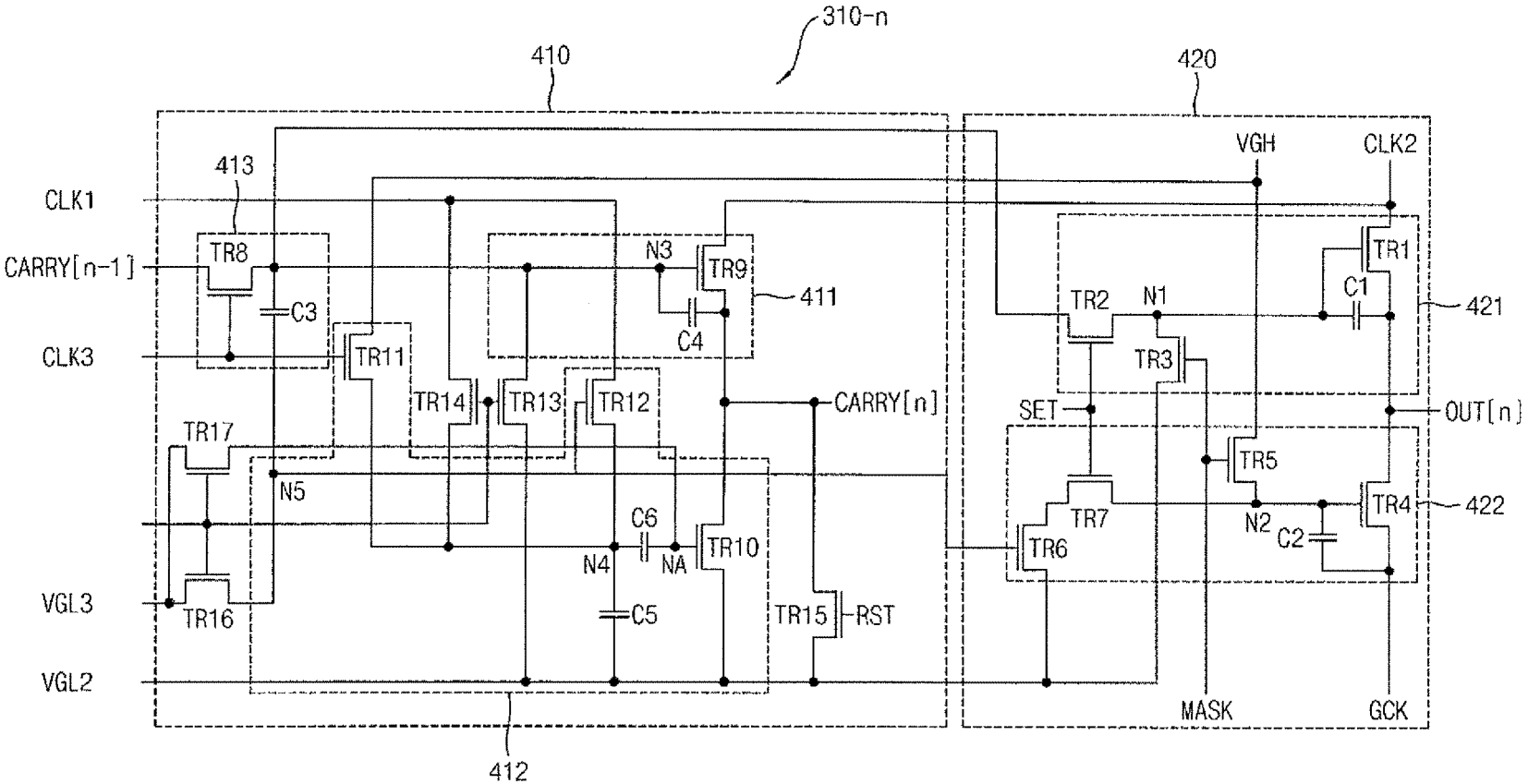
FIG. 4 is a circuit diagram illustrating an example of a gate driving unit included in the gate driver of FIG. 3.

FIG. 4 is a circuit diagram illustrating an example of a gate driving unit included in the gate driver of FIG. 3.

Referring to FIG. 4, the gate driving unit 310-n may include a shift register 410 and a mask 420.

The shift register 410 may receive an (n−1)th carry signal Carry[n−1] from an (n−1)th gate driving unit 310-n−1 located adjacent to the (n)th gate driving unit 310-n and may output an (n)th carry signal Carry[n] based on the (n−1)th carry signal Carry[n−1] and clock signals CLK1 through CLK3.

In example embodiments, shift register 410 may include a second pull-up block 411 to transmit the (n−1)th carry signal Carry[n−1] to a third node N3 and to output the second clock signal CLK2 as the (n)th carry signal Carry[n] based on a voltage at the third node N3, and a second pull-down block 412 to transmit the high voltage VGH to a fourth node N4 in response to the first clock signal CLK1 and to pull down the (n)th carry signal Carry[n] to have the second low voltage VGL2 based on a voltage at the fourth node N4.

The second pull-up block 411 may include a ninth transistor TR9 and a fourth capacitor C4. The ninth transistor TR9 may include a first electrode for receiving the second clock signal CLK2, a second electrode that is electrically connected to an output terminal from which the (n)th carry signal Carry[n] is outputted, and a gate electrode that is electrically connected to the third node N3. The fourth capacitor C4 may be electrically connected between the third node N3 and the second electrode of the ninth transistor TR9, and may store a voltage at the third node N3.

For example, when the second pull-up block 411 receive the (n−1)th carry signal Carry[n−1] having a logic high level, the second pull-up block 411 may transmit the (n−1)th carry signal Carry[n−1] having the logic high level to the third node N3 and may output the second clock signal CLK2 as the (n)th carry signal Carry[n] in response to a voltage at the third node N3 (e.g., VGH). Here, the fourth capacitor C4 may amplify a voltage at the third node N3 (i.e., the capacitor C4 may operate as a boosting capacitor) based on a stored voltage (e.g., VGH) and may allow the (n)th carry signal Carry[n] to increase to the logic high level more quickly. For example, the fourth capacitor C4 may amplify a voltage at the third node N3 to a voltage that is twice as high as the voltage VGH (i.e., 2*VGH). Therefore, even though a threshold voltage Vth of the ninth transistor TR9 is shifted with positive values (or, positively shifted) or shifted with negative values (or, negatively shifted) by stress, the ninth transistor TR9 may stably operate.

For example, when the second pull-up block 411 receives the (n−1)th carry signal Carry[n−1] having a logic low level, the second pull-up block 411 may maintain the voltage at the third node N3 at the second low voltage VGL2 corresponding to the logic low level.

The second pull-down block 412 may include a tenth transistor TR10, an eleventh transistor TR11, and a fifth capacitor C5. The tenth transistor TR10 may include a first electrode that is electrically connected to an output terminal from which the (n)th carry signal Carry[n] is outputted, a second electrode that is electrically connected to the second low voltage VGL2, and a gate electrode that is electrically connected to a fourth node N4. The eleventh transistor TR11 may include a first electrode for receiving the high voltage VGH, a second electrode that is electrically connected to the fourth node N4, and a gate electrode for receiving the third clock signal CLK3. The fifth capacitor C5 may be electrically connected between the fourth node N4 and the second low voltage VGL2 and may store a voltage at the fourth node N4.

For example, the second pull-down block 412 may transmit the high voltage VGH to the fourth node N4 in response to a third clock signal CLK3 and may pull down the (n)th carry signal Carry[n] to have the second low voltage VGL2 in response to the voltage at the fourth node N4.

The second pull-down block 412 may further include a sixth capacitor C6 that is electrically connected between the fourth node N4 and the tenth transistor TR10. The sixth capacitor C6 may capacitively couple the fourth node N4 and the tenth transistor TR10. For example, the sixth capacitor C6 may store ΔV volt (V) during a reset period (i.e., a period in which the gate driver 140 is initialized), may increase or decrease a voltage at the fourth node N4 with ΔV volt (V) (e.g., VGH−ΔV), and may supply the tenth transistor TR10 with an increased voltage at the fourth node N4. Therefore, even though a threshold voltage Vth of the tenth transistor TR10 is shifted with positive values or negative values, the tenth transistor TR10 may perform a turn-on operation or a turn-off operation stably.

The second pull-down block 412 may further include a twelfth transistor TR12. The twelfth transistor TR12 may include a first electrode for receiving the first clock signal CLK1, a second electrode that is electrically connected to the fourth node N4, and a gate electrode that is electrically connected to a fifth node N5 (and receives the synchronized (n−1)th carry signal Carry[n−1]).

For example, the twelfth transistor TR12 may transfer the first clock signal CLK1 to the fourth node N4 in response to the (n−1)th carry signal Carry[n−1]. For example, the twelfth transistor TR12 may transfer the first clock signal CLK1 having a logic low level to the fourth node N4 in response to the (n−1)th carry signal Carry[n−1] having a logic high level, and the second pull-down block 412 may not pull down the gate signal OUT[n] in response to a voltage at the fourth node N4 (e.g., VGL2).

The shift register 410 may further include a pulling control unit (e.g., a pulling controller) 413. The pulling control unit 413 may include an eighth transistor TR8 and a third capacitor C3. The eighth transistor TR8 may include a first electrode receiving the (n−1)th carry signal Carry[n−1], a second electrode that is electrically connected to the third node N3, and a gate electrode for receiving the third clock signal CLK3. The third capacitor C3 may be electrically connected between the third node N3 and a gate electrode of the twelfth transistor TR12 (i.e., the fifth node N5).

The pulling control unit 413 may provide the (n−1)th carry signal Carry[n−1] to the pull-up block 411 and the pull-down block 412. The third capacitor C3 may capacitively couple the third node N3 and the twelfth transistor TR12. Therefore, even though a threshold voltage Vth of the twelfth transistor TR12 is shifted with positive values or negative values, the twelfth transistor TR12 may perform a turn-on operation or a turn-off operation stably.

In an example embodiment, the shift register 410 may further include a reset block that initializes a voltage at the third node N3, a voltage at the fourth node N4, and the (n)th carry signal Carry[n] (at an output terminal of the shift register 410) to the low voltages VGL1 and VGL2 in response to a reset signal RST.

The reset block may include a thirteenth transistor TR13, a fourteenth transistor TR14, and a fifteenth transistor TR15. The thirteenth transistor TR13 may include a first electrode that is electrically connected to the third node N3, a second electrode that is electrically connected to the second low voltage VGL2, and a gate electrode for receiving the reset signal RST. The fourteenth transistor TR14 may include a first electrode that is electrically connected to the first clock signal (e.g., the first low voltage VGL1), a second electrode that is electrically connected to the fourth node N4, and a gate electrode for receiving the reset signal RST. The fifteenth transistor TR15 may include a first electrode that is electrically connected to the output terminal from which the (n)th carry signal Carry[n] is outputted, a second electrode that is electrically connected to the second low voltage VGL2, and a gate electrode for receiving the reset signal RST.

In an example embodiment, the reset block may initialize the third capacitor C3 and the sixth capacitor C6. The reset block may include a sixteenth transistor TR16 and a seventeenth transistor TR17. The sixteenth transistor TR16 may include a first electrode for receiving the third low voltage VGL3, a second electrode that is electrically connected to the fifth node N5, and gate electrode for receiving the reset signal RST. The seventeenth transistor TR17 may include a first electrode for receiving the third low voltage VGL3, a second electrode that is electrically connected to a node A (i.e., a node that is electrically connected to the sixth capacitor C6 and a gate electrode of the tenth transistor TR10), and a gate electrode for receiving the reset signal RST. Because the reset block may initialize the fifth node N5 and the node A to the third low voltage VGL3, the third capacitor may be initialized to a voltage difference between the third node N3 and the fifth node N5 (i.e., VGL2−VGL3=ΔV), and the sixth capacitor C6 may be initialized to a voltage difference between the fourth node N4 and the node A (VGL−VGL3=2*ΔV).

The mask 420 may output the gate signal OUT[n] based on the synchronized (n−1)th carry signal Carry[n−1] and the mask signal MASK.

The mask 420 may include a first pull-up block 421 and a first pull-down block 422. The first pull-up block 421 may transmit the synchronized (n−1)th carry signal Carry[n−1] to the first node N1 in response to a ready signal SET and may output the second clock signal CLK2 as the gate signal OUT[n] based on a voltage at the first node N1. The first pull-down block 422 may transmit the high voltage VGH to the second node N2 in response to the mask signal MASK and may pull down the gate signal OUT[n] to have a low power voltage (i.e., a power signal GCK) based on a voltage at the second node N2. Here, the ready signal SET may be a control signal for the gate driving unit 310-n to initiate (e.g., prepare) outputting the gate signal OUT[n], and the mask signal MASK may be a control signal to prevent the gate driving unit 310-n from outputting the gate signal OUT[n].

For example, when the (n)th gate driving unit 310-n receives the ready signal SET having a logic high level, the (n)th gate driving unit 310-n may output the gate signal OUT[n] having the logic high level based on the (n−1)th carry signal Carry[n−1] having the logic high level in a next period. For example, when the (n)th gate driving unit 310-n receives the mask signal MASK having the logic high level, the (n)th gate driving unit 310-n may output the gate signal OUT[n] having a logic low level regardless of the ready signal SET and the (n−1)th carry signal Carry[n−1].

The first pull-up block 421 may include a first transistor TR1, a second transistor TR2, and a first capacitor C1. The first transistor TR1 may include a first electrode for receiving the second clock signal CLK2, a second electrode for outputting the gate signal OUT[n], and a gate electrode that is electrically connected to the first node N1. The second transistor TR2 may include a first electrode for receiving the synchronized (n−1)th carry signal Carry[n−1], a second electrode that is electrically connected to the first node N1, and a gate electrode for receiving the ready signal SET. The first capacitor C1 may be electrically connected between the first node N1 and a second electrode of the first transistor TR1 and may store a voltage at the first node N1. Therefore, the first pull-up block 421 may transmit the (n−1)th carry signal Carry[n−1] having the logic high level to the first node N1 in response to the ready signal SET, and may output the second clock signal CLK2 as the gate signal OUT[n] based on the voltage at the first node N1 (e.g., VGH). Here, the first capacitor C1 may amplify a voltage at the first node N1 according to a stored voltage (e.g., VGH) (i.e., the capacitor C1 operates as a boosting capacitor) and may allow the (n)th carry signal Carry[n] to increase to the logic high level more quickly.

The first pull-up block 421 may further include a third transistor TR3. The third transistor TR3 may include a first electrode for receiving the second low voltage VGL2, a second electrode that is electrically connected to the first node N1, and a gate electrode for receiving the mask signal MASK. Therefore, the first pull-up block 421 may maintain the first node N1 at the second low voltage VGL2 during a period in which the first pull-up block 421 receives the mask signal MASK having a logic high level.

The first pull-down block 422 may include a fourth transistor TR4, a fifth transistor TR5, and a second capacitor C2. The fourth transistor TR4 may include a first electrode that is electrically connected to an output terminal from which the gate signal OUT[n] is outputted, a second electrode that is electrically connected to the second low voltage VGL2, and a gate electrode that is electrically connected to the second node N2. The fifth transistor TR5 may include a first electrode that is electrically connected to the high voltage VGH, a second electrode that is electrically connected to the second node N2, and a gate electrode for receiving the mask signal MASK. The second capacitor C2 may be electrically connected between the second node N2 and a second electrode of the fourth transistor TR4 and may store a voltage at the second node N2. Therefore, the first pull-down block 422 may transmit the high voltage VGH to the second node N2 in response to the mask signal MASK having a logic high level and may pull down the gate signal OUT[n] to have the low power voltage (i.e., the power signal GCK).

The first pull-down block 422 may further include a sixth transistor TR6 and a seventh transistor TR7. The sixth transistor TR6 and the seventh transistor TR7 may be electrically connected in series between the second low voltage VGL2 and the second node N2 and may be diode-coupled in response to the synchronized (n−1)th carry signal Carry[n−1] and the ready signal SET, respectively. Therefore, the first pull-down block 422 may maintain the second node N2 at the second low voltage VGL2 in response to the (n−1)th carry signal Carry[n−1] having a logic high level and the ready signal SET having a logic high level.

The mask 420 may further include a pulling control unit. The pulling control unit may be substantially the same as or similar to the pulling control unit described with reference to the shift register 410. The gate driving unit 310-n may control the shift register 410 and the mask 420 by using one pulling control unit, or may respectively control the shift register 410 and the mask 420 by using pulling control units provided separately from each other.

The gate driver 140 illustrated in the FIG. 4 may include an N-channel metal oxide semiconductor (NMOS) transistor. However, a transistor is not limited thereto. For example, the transistor may be a P-channel metal oxide semiconductor (PMOS) transistor.

Figure 5:
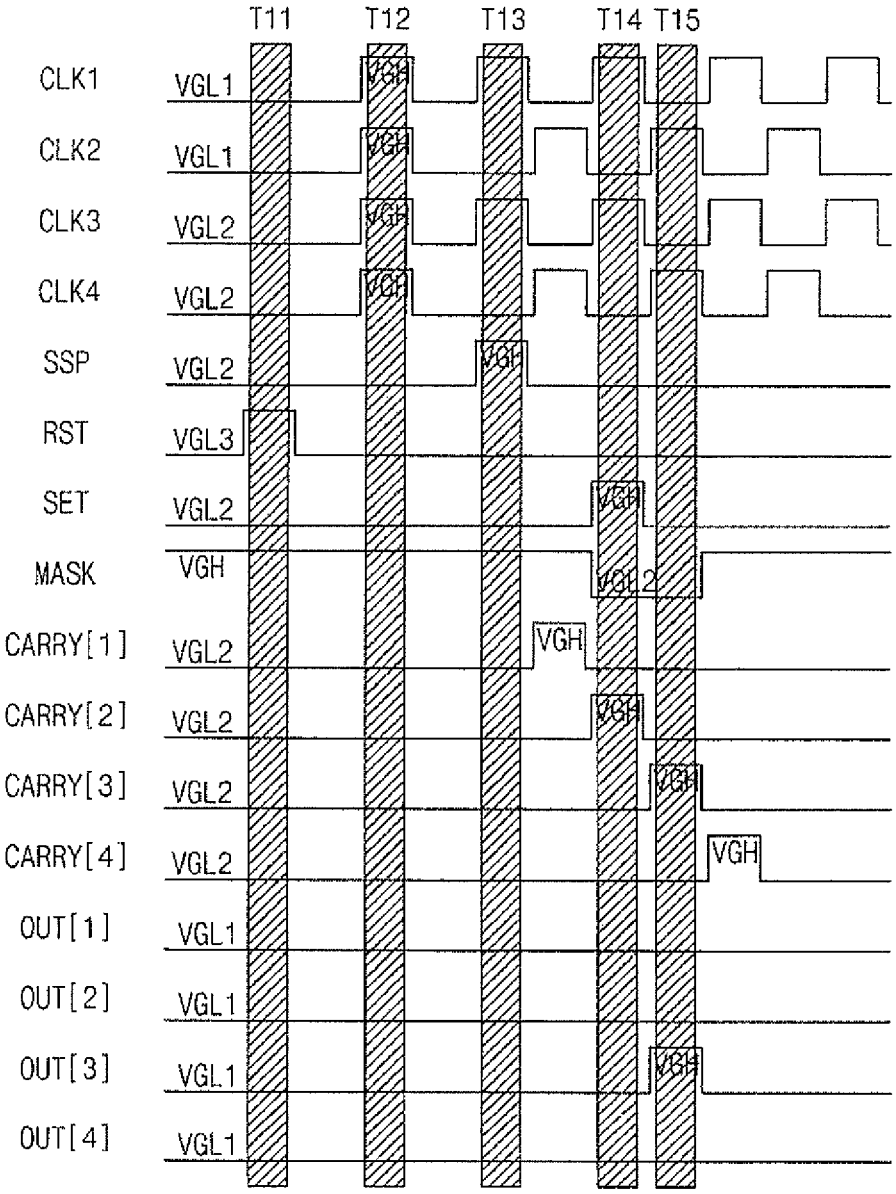
FIG. 5 is a waveform diagram for describing an operation of the gate driver of FIG. 3.

FIG. 5 is a waveform diagram for describing an operation of the gate driver of FIG. 3.

Referring to FIGS. 3 and 5, one frame may include a first initializing period T11, a second initializing period T12, a start pulse supplying period T13, a ready period T14, and an output period T15. For example, the sensing voltage supplying period T3, the sensing period T4, or the data writing period data writing period T5 described with reference to FIG. 2B may include the first initializing period T11, the second initializing period T12, the start pulse supplying period T13, the ready period T14, and the output period T15.

In the first initializing period T11, the reset signal RST and the mask signal MASK may have a logic high level, and the rest of the signals may have a logic low level.

The shift register 410 of each of the gate driving units 310-1 through 310-4 may initialize the third through fifth nodes N3, N4, and N5, a node A, and an output terminal of the shift register 410 to logic low levels (e.g., VGL2 or VGL3) in response to the reset signal RST. The seventeenth transistor TR17 may be turned on in response to the reset signal RST having a logic high level, and a node A may be initialized with the third low voltage VGL3. The sixteenth transistor TR16 may be turned on and may initialize the fifth node N5 to the third low voltage VGL3. The fourteenth transistor TR14 may be turned on, and the fourth node N4 may be charged with a first low voltage VGL1 that is supplied as the first clock signal CLK1. The thirteen transistor TR13 may be turned on, and the third node N3 may be charged with the second low voltage VGL2. The fifteenth transistor TR15 may be turned on, and the output terminal of the shift register 410 may be initialized to the second low voltage VGL2. Here, the third capacitor C3 may be charged with a voltage difference between the third node N3 and the fifth node N5 (VGL2−VGL3=ΔV), and the sixth capacitor C6 may be charged with a voltage difference between the fourth node N4 and the node A (VGL−VGL3=2*ΔV).

The mask 420 of each of the gate driving units 310-1 through 310-4 may output the gate signal OUT[n] having a logic low level in response to the mask signal MASK having a logic high level. The third transistor TR3 and the fifth transistor TR5 may be turned on in response to the mask signal MASK, the first node N1 may be charged with the second low voltage VGL2, and the second node N2 may be charged with the high voltage VGH. Therefore, the gate driving unit 310-n may output the gate signal OUT[n] having the first low voltage VGL1 (i.e., the power signal GCK) corresponding to an operation of the first pull-down block 422.

The power signal GCK may be the first low voltage VGL1 in performing sequential driving and selective driving of the gate driver 140, and may be the high voltage VGH in a concurrent driving (e.g., a simultaneous driving) of the gate driver 140. For example, because the first pull-down block 422 may output the high voltage VGH when the power signal GCK is supplied with the high voltage VGH, all of gate driving units 310-1 through 310-4 may concurrently (e.g., simultaneously) output the gate signals OUT[1] through OUT[4] having a logic high level.

In the second initializing period T12, clock signals CLK1 through CLK4 and the mask signal MASK may have a logic high level, and the rest of the signals may have a logic low level.

Here, the gate driving units 310-1 through 310-4 may output carry signals Carry[1] through Carry[4] having a logic low level by using the shift register 410. The eighth transistor TR8 may be turned on in response to the third clock signal CLK3 and the fourth clock signal CLK4, and may charge the third node N3 with a logic low level of the (n−1)th carry signal Carry[n−1]. The eleventh transistor TR11 may be turned on and may charge the fourth node N4 with the high voltage VGH. A voltage of the node A may be VGH−ΔV volt (V) according to a capacitive coupling of the sixth capacitor C6 (i.e., according to a stored voltage ΔV of the sixth capacitor C6). Therefore, the tenth transistor TR10 may be turned on and may pull down the (n)th carry signal Carry[n] to have the second low voltage VGL2.

The mask 420 of each of the gate driving units 310-1 through 310-4 may output the gate signal OUT[n] having a logic low level in response to the mask signal MASK having a logic high level. An operation of the mask 420 may be substantially the same as or similar to an operation of the mask 420 in the first initializing period T11. Therefore, duplicated description for an operation of the mask 420 in the second initializing period T12 may not be provided.

In the start pulse supplying period T13, the first clock signal CLK1, the third clock signal CLK3, the start pulse signal SSP, and the mask signal MASK may have a logic high level, and the rest of the signals including the second clock signal CLK2 may have a logic low level.

The shift register 410 of the first gate driving unit 310-1 may initiate outputting (e.g., prepare to output) the first carry signal Carry[1] having a logic high level based on the start pulse signal SSP. The eighth transistor TR8 may be turned on in response to the first clock signal CLK1, and the third node N3 may be charged with the start pulse signal SSP by the fourth capacitor C4. However, the shift register 410 may output the first carry signal Carry[1] having a logic low level according to the second clock signal CLK2 having a logic low level.

The mask 420 of the first gate driving unit 310-1 may output the gate signal OUT[1] having a logic low level. A voltage of the fifth node N5 may be VGH−ΔV volt (V) according to a capacitive coupling of the third capacitor C3, and the sixth transistor TR6 may be turned on. Because the third transistor TR3 and the fifth transistor TR5 may maintain a turn-on state according to the mask signal MASK having a logic high level, the first gate driving unit 310-1 may output the gate signal OUT[1] having the first low voltage VGL1 (i.e., the power signal GCK) according to an operation of the first pull-down block 422.

After the start pulse signal SSP is supplied, the shift register 410 of an (n)th gate driving unit 310-n may output the (n)th carry signal Carry[n] having a logic high level based on an (n−1)th carry signal Carry[n−1] having a logic high level, where n is an integer of 2 or more.

Immediately after the start pulse supplying period T13, the first clock signal CLK1 and the third clock signal CLK3 may be changed in a logic low level state, the second clock signal CLK2 and the fourth clock signal CLK4 may be changed in a logic high level state, and the start pulse signal SSP may have a logic low level.

Here, the shift register 410 of the first gate driving unit 310-1 may output the second clock signal CLK2 having a logic high level as the first carry signal Carry[1] based on the start pulse signal SSP stored in a previous period (e.g., the start pulse supplying period T13). The eighth transistor TR8 may be turned on according to the third clock signal CLK3 having a logic low level, but the third node N3 may have the high voltage VGH according to a stored voltage of the fourth capacitor C4. The ninth transistor TR9 may maintain a turn-on state and may output the second clock signal CLK2 having a logic high level as the first carry signal Carry[1]. The fourth capacitor C4 may amplify a voltage at the third node N3 (i.e., the capacitor C4 operates as a boosting capacitor) based on the first carry signal Carry[1] having a logic high level and the stored voltage (i.e., VGH) and may allow the first carry signal Carry[1] to be raised to a logic high level more quickly. For example, the fourth capacitor C4 may amplify a voltage at the third node N3 to a voltage that is twice as high as the voltage VGH (i.e., 2*VGH). Therefore, even though a threshold voltage of the ninth transistor TR9 is shifted with positive values or negative values, the ninth transistor TR9 may be turned on stably.

The first carry signal Carry[1] may be used as a start pulse signal of the second gate driving unit 310-2. Here, the second gate driving unit 310-2 may operate in the same way as the first gate driving unit 310-1 in the start pulse supplying period T13. The duplicated description for an operation of the second gate driving unit 310-2 may not be provided.

After a half clock cycle (e.g., a half cycle of clock signals) has elapsed, the second gate driving unit 310-2 may output a second carry signal Carry[2] having a logic high level based on the first carry signal Carry[1] having a logic high level. At the same time, the third gate driving unit 310-3 may output a third carry signal Carry[3] having a logic low level based on the second carry signal Carry[2] having a logic low level.

As described above, after the start pulse signal SSP is supplied to the gate driver 140, the (n)the gate driving unit 310-n may output the (n)th carry signal Carry[n] having a logic high level by shifting the (n−1)th carry signal Carry [n−1] (or, the start pulse signal). The (n)th gate driving unit 310-n may output the gate signal OUT[n] having a logic low level according to the mask signal MASK having a logic high level. Therefore, the gate driver 140 may generate a carry signal sequentially and may sequentially output a gate signal having a logic low level according to the mask signal MASK having a logic high level.

In the ready period T14, the ready signal SET may have a logic high level, and the mask signal MASK may have a logic low level. In the ready period T14, some of the gate driving units 310-1 through 310-4 may initiate outputting (e.g., prepare to output) the gate signal having a logic high level.

In the mask 420 of the (n)th gate driving unit 310-n, the third transistor TR3 and the fifth transistor may be turned off in response to the mask signal MASK, and the second transistor TR2 and the seventh transistor TR7 may be turned on. Therefore, the first node N1 may be charged with the (n−1)th carry signal Carry[n−1] synchronized by the third clock signal CLK3. For example, as illustrated in FIG. 5, the second carry signal Carry[2] may have a logic high level. Therefore, the first node N1 of the third gate driving unit 310-3 may be charged with the high voltage VGH.

When the first node N1 is charged with the high voltage VGH, the first transistor TR1 may be turned on, and the (n)th gate driving unit 310-n may initiate outputting (e.g., prepare to output) the (n)th gate signal OUT[n] having a logic high level. For example, the first transistor TR1 of the third driving unit 310-3 may be turned on, and the first pull-up block 421 may operate. However, the second clock signal CLK2 may have a logic low level, and the third gate driving unit 310-3 may generate the third carry signal Carry[3] having a logic low level.

The second node N2 may be charged with the second low voltage VGL2 in response to the (n−1)th carry signal Carry [n−1] synchronized by the third clock signal CLK3 (i.e., a voltage at the third node N3 that is capacitively coupled by the third capacitor C3). For example, the third gate driving unit 310-3 may receive the second carry signal Carry[2] having a logic high level. Here, the sixth transistor TR6 may be turned on, and the second node N2 may be charged with the second low voltage VGL2. Therefore, the fourth transistor TR4 may be turned off.

As described above, the mask 420 of the (n)th gate driving unit 310-n may charge the first node N1 with the (n−1)th carry signal Carry[n−1] based on the ready signal SET and the mask signal MASK and may initiate outputting (e.g., prepare to output) the (n)th gate signal OUT[n].

It is illustrated in FIG. 5 that the first clock signal CLK1 and the third clock signal CLK3 have a logic low level and the second clock signal CLK2 and the fourth clock signal CLK4 may have a logic high level. However, an operation of the (n)th gate driving unit 310-n in the ready period T14 is not limited thereto. For example, even though the first clock signal CLK1 and the third clock signal CLK3 have a logic high level and the second clock signal CLK2 and the fourth clock signal CLK4 have a logic low level, the (n)th gate driving unit 310-n may initiate outputting (e.g., prepare to output) the (n)th gate signal OUT[n] according to a level of each of the ready signal SET and the mask signal MASK.

In the output period T15, the ready signal SET and the mask signal MASK may have a logic low level.

In the mask 420 of the (n)th gate driving unit 310-n, the second transistor TR2, the seventh transistor TR7, the third transistor TR3, and the fifth transistor TR5 may be turned off. Because the first node N1 is charged with the (n−1)th carry signal Carry[n−1] by the first capacitor C1 , the first transistor TR1 may be turned on according to a voltage at the first node N1.

For example, because the first node N1 of the third gate driving unit 310-3 maintains a state charged with the high voltage VGH, the first transistor TR1 may maintain a turn-on state. Therefore, the third gate driving unit 310-3 may output the second clock signal CLK2 having a logic high level as the third gate signal OUT[3].

After the output period T15, the mask signal MASK may be changed in a logic high level state. Therefore, the (n)th gate driving unit 310-n may generate the (n)th gate signal OUT[n] having a logic low level using the mask 420. After the output period T15, an operation of the mask 420 may be substantially the same as or similar to that of the mask 420 in the first initializing period T11. Duplicated description for an operation of the mask 420 may not be provided.

As described above, after the start pulse SSP is supplied, the gate driver 140 may generate (or shift) a carry signal sequentially and may output a gate signal for a certain pixel row when the ready signal SET having a logic high level and the mask signal MASK having a logic low level are supplied to the gate driver 140.

For example, the gate driver 140 may select the certain pixel rows based on a first time at which the start pulse signal SSP having a logic high level is supplied, a second time at which the ready signal SET having a logic high level is supplied, and a third time at which the mask signal MASK having a logic low level is supplied, and may provide the gate signal to the selected pixel rows (i.e., the certain pixel rows).

Figure 6:
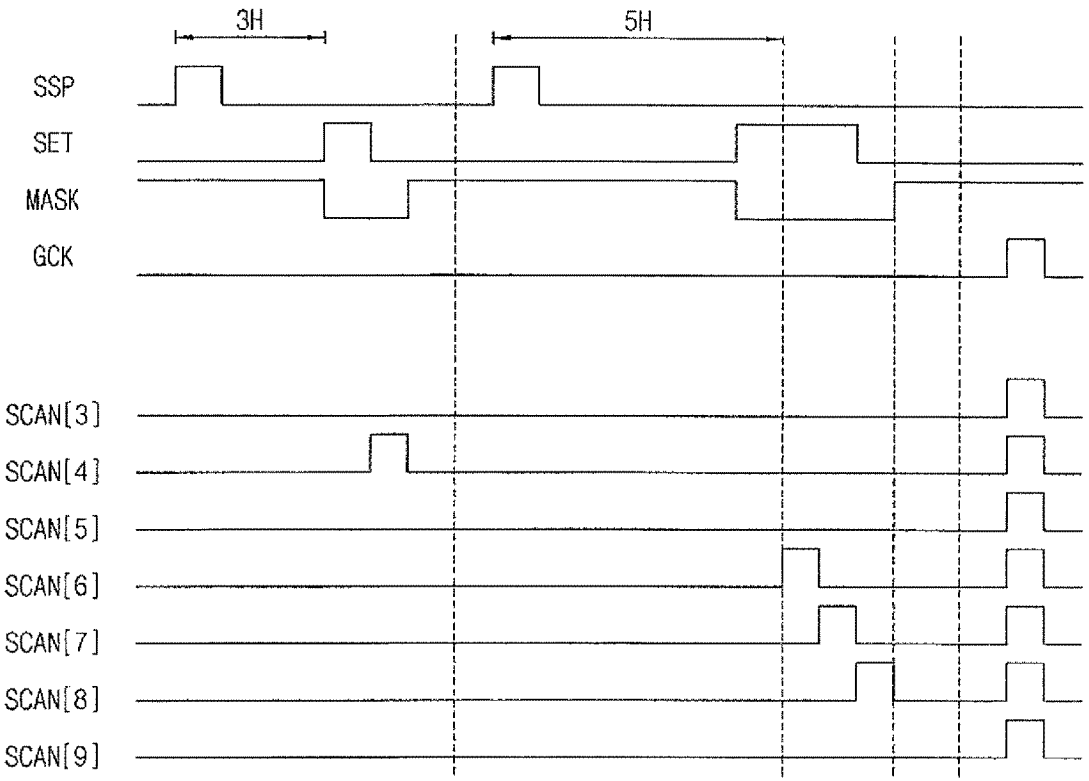
FIG. 6 is a waveform diagram for describing an operation of the gate driver of FIG. 3.

FIG. 6 is a waveform diagram for describing an operation of the gate driver of FIG. 3.

Referring to FIGS. 3 and 6, when the ready signal SET having a logic high level is supplied at a time when a period of 3H has passed from a time at which the start pulse signal SSP is supplied, the fourth gate signal SCAN[4] with a logic high level may be outputted. Here, 1H may represent a half cycle of a clock signal and may be a unit time for an operation of a gate driving unit 140. In some examples, the duration of the start pulse signal SSP is about 1H.

Because the mask signal MASK maintains a logic low level during only 1H after the ready signal SET is supplied, only the fourth gate signal SCAN[4] may be outputted with a logic high level, and the rest of the gate signals may maintain a logic low level.

Therefore, the gate driver 140 may select only a fourth pixel row, and pixels in the fourth pixel row may receive a sensing voltage or may sense (e.g., detect or measure) a driving current.

When the ready signal SET having a logic high level is supplied at a time when a period of 5H has passed from a time at which the start pulse signal SSP is supplied, a sixth gate signal SCAN[6] may be outputted with a logic high level. Because the mask signal MASK is supplied during a period of 4H from the time at which the ready signal SET having a logic high level is supplied, a sixth gate signal SCAN[6], a seventh gate signal SCAN[7], and an eighth gate signal SCAN[8] may be output with a logic high level sequentially.

Therefore, the gate driver 140 may select the sixth through eighth pixel rows sequentially.

When the power signal GCK of the gate driving units 310-1 through 310-4 is supplied with the high voltage VGH, each of the gate driving units 310-1 through 310-4 may output a gate signal having a logic high level regardless of other signals (e.g., MASK, SET, SSP, and etc.) as described with reference to FIG. 3.

Therefore, the gate driver 140 may control pixels in all of the pixel rows to emit light concurrently (e.g., simultaneously).

As described above, the gate driver 140 may be capable of performing selective driving for some pixel rows as well as sequential driving for all of the pixel rows based on a first time at which the start pulse signal SSP having a logic high level is supplied, a second time at which the ready signal SET having a logic high level is supplied, and a third time at which the mask signal MASK having a logic low level is supplied, and may provide the gate signal to the selected pixel rows. In addition, the gate driver 140 may be capable of a concurrent driving (e.g., a simultaneous driving) for all of the pixel rows by supplying a logic high level (e.g., the high voltage VGH) as the power signal GCK of the gate driving units 310-1 through 310-4.

The present inventive concept may be applied to any display device (e.g., an organic light emitting display device, a liquid crystal display device, etc.) including a gate driver. For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of the invention as defined by the claims, and equivalents thereof. In the claims, means-plus-function clauses are intended to cover the structures described herein as performing the recited function and also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

It will also be understood that when a component is referred to as being "between" two components, it can be the only component between the two layers, or one or more intervening components may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The gate driver and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the gate driver may be formed on one integrated circuit (IC) chip or on separate IC chips. Further, the various components of the gate driver may be implemented on a flexible printed circuit film, a tape carrier package (TCP), a printed circuit board (PCB), or formed on a same substrate. Further, the various components of the gate driver may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

What is claimed is:

1. A gate driver comprising:

a plurality of gate sub-drivers electrically connected to a plurality of gate lines, wherein an (n)th gate sub-driver, of the gate sub-drivers comprises:

a shift register configured to receive an (n−1)th carry signal from an (n−1)th gate sub-driver of the gate sub-drivers adjacent to the (n)th gate sub-driver, to synchronize the (n−1)th carry signal with a first clock signal, and to output an (n)th carry signal based on the synchronized (n−1)th carry signal; and a mask configured to output a gate signal based on the synchronized (n−1)th carry signal and a mask signal, wherein n is an integer greater than or equal to 2, and wherein the mask comprises:

a pull-up block configured to transmit the synchronized (n−1)th carry signal to a first node in response to a ready signal and to output a second clock signal as the gate signal based on a voltage at the first node; and a pull-down block configured to provide a second node with a high voltage in response to the mask signal and to pull down the gate signal to have a low power voltage based on a voltage at the second node, wherein the second clock signal is an inverted signal of the first clock signal.

2. The gate driver of claim 1, wherein the (n)th gate sub-driver is configured to initiate outputting the gate signal in response to the ready signal, and wherein the (n)th gate sub-driver is further configured to stop outputting the gate signal in response to the mask signal.

3. The gate driver of claim 1, wherein the mask is configured to output the second clock signal as the gate signal when the ready signal has a logic high level, and wherein the mask is further configured to output the low power voltage as the gate signal when the mask signal has a logic high level.

4. The gate driver of claim 1, wherein the pull-up block comprises:

a first transistor comprising a first electrode configured to receive the second clock signal, a second electrode electrically connected to an output terminal configured to output the gate signal, and a gate electrode electrically connected to the first node;

a second transistor comprising a first electrode configured to receive the (n−1)th carry signal, a second electrode electrically connected to the first node, and a gate electrode configured to receive the ready signal; and a first capacitor electrically connected between the first node and the second electrode of the first transistor and configured to store a voltage at the first node.

5. The gate driver of claim 4, wherein the pull-up block further comprises:

a third transistor comprising a first electrode configured to receive a low voltage, a second electrode electrically connected to the first node, and a gate electrode configured to receive the mask signal.

6. The gate driver of claim 1, wherein the pull-down block comprises:

a fourth transistor comprising a first electrode electrically connected to an output terminal configured to output the gate signal, a second electrode electrically connected to the low power voltage, and a gate electrode electrically connected to the second node;

a fifth transistor comprising a first electrode electrically connected to a high voltage source, a second electrode electrically connected to the second node, and a gate electrode configured to receive the mask signal; and a second capacitor electrically connected between the second node and the second electrode of the fourth transistor and configured to store a voltage at the second node.

7. The gate driver of claim 6, wherein the pull-down block further comprises:

a sixth transistor and a seventh transistor, the sixth and seventh transistors electrically connected in series between a low voltage source and the second node, wherein the sixth transistor is configured to operate in response to the (n−1)th carry signal, and wherein the seventh transistor is configured to operate in response to the ready signal.

8. The gate driver of claim 1, wherein the mask further comprises:

an eighth transistor configured to transfer the (n−1)th carry signal to the pull-up block in response to a third clock signal, and wherein a logic low level of the third clock signal is lower than a logic low level of the first clock signal.

9. A gate driver comprising:

a plurality of gate sub-drivers electrically connected to a plurality of gate lines, wherein an (n)th gate sub-driver, of the gate sub-drivers comprises:

a shift register configured to receive an (n−1)th carry signal from an (n−1)th gate sub-driver of the gate sub-drivers adjacent to the (n)th gate sub-driver, to synchronize the (n−1)th carry signal with a first clock signal, and to output an (n)th carry signal based on the synchronized (n−1)th carry signal; and a mask configured to output a gate signal based on the synchronized (n−1)th carry signal and a mask signal, wherein n is an integer greater than or equal to 2, and wherein the shift register comprises:

a second pull-up block configured to transmit the (n−1)th carry signal to a third node and to output a second clock signal as the (n)th carry signal based on a voltage at the third node; and a second pull-down block configured to transmit a high voltage to a fourth node in response to the first clock signal and to pull down the (n)th carry signal to have a low voltage based on a voltage at the fourth node, and wherein the second clock signal is an inverted signal of the first clock signal.

10. The gate driver of claim 9, wherein the second pull-up block comprises:

a ninth transistor comprising a first electrode configured to receive the second clock signal, a second electrode electrically connected to an output terminal configured to output the (n)th carry signal, and a gate electrode electrically connected to the third node; and a fourth capacitor electrically connected between the third node and the second electrode of the ninth transistor and configured to store a voltage at the third node.

11. The gate driver of claim 9, wherein the second pull-down block comprises:

a tenth transistor comprising a first electrode electrically connected to an output terminal configured to output the (n)th carry signal, a second electrode electrically connected to a low voltage source supplying the low voltage, and a gate electrode electrically connected to the fourth node;

an eleventh transistor comprising a first electrode configured to receive the high voltage, a second electrode electrically connected to the fourth node, and a gate electrode configured to receive a third clock signal; and a fifth capacitor electrically connected between the fourth node and the low voltage source and configured to store a voltage at the fourth node.

12. The gate driver of claim 11, wherein the second pull-down block further comprises:

a sixth capacitor electrically connected between the fourth node and the gate electrode of the tenth transistor.

13. The gate driver of claim 11, wherein the second pull-down block further comprises:

a twelfth transistor comprising a first electrode configured to receive the first clock signal, a second electrode electrically connected to the fourth node, and a gate electrode configured to receive the (n−1)th carry signal.

14. The gate driver of claim 13, wherein the shift register further comprises:

an eighth transistor comprising a first electrode configured to receive the (n−1)th carry signal, a second electrode electrically connected to the third node, and a gate electrode configured to receive the third clock signal; and a third capacitor electrically connected between the third node and the gate electrode of the twelfth transistor.

15. The gate driver of claim 9, wherein the shift register further comprises:

a reset block configured to initialize a voltage at the third node, a voltage at a forth node, and a voltage at an output terminal from which the (n)th carry signal is output to have the low voltage based on a reset signal.

16. The gate driver of claim 15, wherein the reset block comprises a plurality of transistors configured to electrically connect the third node, the fourth node, and the output terminal to the low voltage in response to the reset signal.

17. A display device comprising:

a display panel comprising a plurality of gate lines, a plurality of data lines, and a plurality of pixels at crossing regions of the gate lines and the data lines;

a data driver configured to provide data signals to the pixels through the data lines;

a timing controller configured to generate a first clock signal and a second clock signal that is an inverted signal of the first clock signal, the timing controller being configured to control the data driver and a gate driver; and the gate driver comprising a plurality of gate sub-drivers electrically connected to the gate lines, the gate sub-drivers being configured to supply a gate signal to the pixels through the gate lines, wherein an (n)th gate sub-drivers of the gate sub-drivers comprises:

a shift register configured to receive an (n−1)th carry signal from an (n−1)th gate sub-driver located adjacent to the (n)th gate sub-driver, to synchronize the (n−1)th carry signal with the first clock signal, and to output an (n)th carry signal based on synchronized (n−1)th carry signal; and a mask configured to output the second clock signal as the gate signal based on the synchronized (n−1)th carry signal and a mask signal, wherein n is an integer greater than or equal to 2, and wherein the mask comprises:

a pull-up block configured to transmit the synchronized (n−1)th carry signal to a first node in response to a ready signal and to output a second clock signal as the gate signal based on a voltage at the first node; and a pull-down block configured to provide a second node with a high voltage in response to the mask signal and to pull down the gate signal to have a low power voltage based on a voltage at the second node, wherein the second clock signal is an inverted signal of the first clock signal.

18. The display device of claim 17, wherein the display panel is configured to receive a sensing voltage from an external component based on the gate signal and to measure a pixel driving current generated based on the sensing voltage.

19. The display device of claim 17, wherein the timing controller is configured to generate a start pulse signal and a ready signal, and wherein the gate driver is configured to selectively drive at least one pixel among the pixels based on the start pulse signal, the ready signal, and the mask signal.

* * * * *